US010260770B2

(12) United States Patent
Constable et al.

(10) Patent No.: US 10,260,770 B2
(45) Date of Patent: Apr. 16, 2019

(54) CONDENSATE COLLECTION DEVICE

(71) Applicant: Charles Austen Pumps Limited, West Byfleet (GB)

(72) Inventors: Jon Constable, Cheesington (GB); William Eric Shepherd, Surrey (GB)

(73) Assignee: CHARLES AUSTEN PUMPS LIMITED, Surrey (GB)

( * ) Notice: Subject to any disclaimer, the term of this patent is extended or adjusted under 35 U.S.C. 154(b) by 0 days.

(21) Appl. No.: 15/694,202

(22) Filed: Sep. 1, 2017

(65) Prior Publication Data

US 2017/0363317 A1 Dec. 21, 2017

Related U.S. Application Data

(63) Continuation of application No. 14/122,887, filed as application No. PCT/GB2012/051229 on May 31, 2012.

(30) Foreign Application Priority Data

Jun. 1, 2011 (GB) ..... 1109240.0

(51) Int. Cl.
*F25D 21/14* (2006.01)
*F24F 13/22* (2006.01)

(52) U.S. Cl.
CPC ..... *F24F 13/22* (2013.01); *F24F 13/222* (2013.01)

(58) Field of Classification Search
CPC .. F24F 13/222; F24F 13/22; F24F 2011/0054; G01F 23/0023; G01F 23/303; H01G 2/02
USPC ..... 62/291
See application file for complete search history.

(56) References Cited

U.S. PATENT DOCUMENTS

| | | | | |
|---|---|---|---|---|
| 4,108,172 | A | 8/1978 | Moore, Jr. | |
| 5,964,371 | A | 10/1999 | McCabe | |
| 5,975,113 | A | 11/1999 | Haining et al. | |
| 6,209,573 | B1 | 4/2001 | Chau | |
| 6,322,326 | B1 * | 11/2001 | Davis | F04D 13/08 417/279 |

(Continued)

FOREIGN PATENT DOCUMENTS

| | | |
|---|---|---|
| EP | 2 270 401 A1 | 1/2011 |
| JP | 08-049872 | 2/1996 |
| WO | 99/06773 A1 | 2/1999 |

OTHER PUBLICATIONS

International Search Report dated Sep. 11, 2012 for International Application No. PCT/GB2012/051229.

*Primary Examiner* — Joseph Trpisovsky
(74) *Attorney, Agent, or Firm* — Patterson + Sheridan, LLP

(57) ABSTRACT

A condensate collection tank (1) for an air conditioning system is provided. The tank (1) comprises a body (20) for storing condensate liquid, a lid (10) releasably connectable to the body (20) to form the tank (1) and a mounting bracket (112) for fixing the lid (10) to a mounting surface. The tank (1) further includes an inlet port (50, 90) for condensate liquid from the air conditioning system, an outlet port (40, 80) for condensate liquid from the tank (1), a sensor (104) for determining whether an amount of condensate liquid in the tank (1) exceeds a threshold value, and a controller for controlling removal of the condensate liquid from the tank (1) via the outlet port (40, 80) when the sensor (104) determines that the threshold value has been exceeded.

23 Claims, 6 Drawing Sheets

(56) References Cited

U.S. PATENT DOCUMENTS

| | | | | |
|---|---|---|---|---|
| 2003/0221439 | A1 | 12/2003 | Bush et al. | |
| 2004/0119211 | A1 | 6/2004 | Robins et al. | |
| 2005/0092009 | A1 | 5/2005 | Thurman | |
| 2006/0005561 | A1 | 1/2006 | Murphy et al. | |
| 2006/0045771 | A1 | 3/2006 | Walker et al. | |
| 2006/0278084 | A1 | 12/2006 | Kim | |
| 2008/0006224 | A1 | 1/2008 | Ahn et al. | |
| 2009/0064698 | A1 | 3/2009 | Spanger | |
| 2010/0037644 | A1 | 2/2010 | Ward | |
| 2010/0052921 | A1 | 3/2010 | Cantolino | |
| 2010/0180618 | A1 | 7/2010 | Gavan | |
| 2011/0019984 | A1 | 1/2011 | Glover | |
| 2011/0061415 | A1 | 3/2011 | Ward | |
| 2011/0088315 | A1 | 4/2011 | Donoghue | |
| 2011/0174714 | A1* | 7/2011 | Hsiao | F24F 13/222 210/236 |
| 2011/0272043 | A1* | 11/2011 | Hollingsworth | F24F 13/222 137/386 |

* cited by examiner

CONDENSATE COLLECTION DEVICE

CLAIM OF PRIORITY UNDER 35 U.S.C. § 119

This is a continuation application of, and claims the benefit of priority from, U.S. patent application Ser. No. 14/122,887, filed May 31, 2012, the applications being assigned to the assignee hereof and expressly incorporated by reference herein in their entireties.

The present invention relates to a condensate collection tank. In particular, the present invention relates to a condensate collection tank for an air conditioning system. However, it is applicable to any system where condensate is formed, for example a boiler system.

Air conditioning systems take in warm air and expel cooler air in order to provide a more comfortable living or working environment. The process of chilling the air causes condensation to form on the heat exchanger, producing a steady stream of water which drips off of the heat exchanger, into a collection tray, and then to a drain. The amount of water produced depends on the humidity level in the environment and other factors.

Many air conditioning installations, for example ceiling or wall-mounted air conditioning units, are sited away from a convenient drain. In these cases a condensate removal pump is typically employed, in combination with a condensate collection tank, to convey the water through a discharge tube to the outside of a building. Such pumps are preferably demand driven so that they only operate when there is water waiting to be discharged from the system. Conventionally, a sensor is provided within the condensate collection tank to determine when the condensate liquid has reached a predetermined level and should be removed from the tank.

During the cooling process, micro-organisms, such as spores and bacteria can collect on the moist surfaces of the heat exchanger. As the air conditioning system cycles on and off, an ideal breeding ground for micro-organisms is provided. This may result in the build-up of organic sludge in the condensate collection tank, which can cause blockages. Consequently, care has to be taken when installing condensate collection tanks to ensure that they can be easily serviced and maintained.

Typically, the condensate collection tank is mounted either within the air conditioning unit, or within a drain conduit of the air conditioning unit, in an attempt to hide the tank from view. However, the capacity of such condensate collection devices is generally reduced due to the confines of the unit or conduit and may not be large enough to store sufficient condensate such that the pump is not required to be continuously running. Further, positioning the tank within the air conditioning unit or drain conduit may hinder the servicing or maintenance of the tank.

Consequently, it may be preferable to position the condensate collection tank adjacent to the air conditioning unit, particularly if the space within the air conditioning unit, or drain conduit is limited. Further, as the condensate will typically drain from the collection tray to the collection tank under the force of gravity, it is preferable for the tank to be positioned underneath the unit.

However, in order for a tank which is mounted underneath an air conditioning unit to be easily serviced and maintained, it is necessary to leave a significant clearance, for example at least 35 mm, between the air conditioning unit and the condensate collection tank. This enables the tank lid to be removed to allow access to the inside of the tank, for example to remove debris, without the need for the tank to be removed from the wall. The presence of such a clearance results in an air conditioning system which occupies a significant wall area, is aesthetically unappealing and requires the routing of additional cable and tubing which increases the installation costs.

The present invention provides a condensate collection tank for an air conditioning system, comprising a body for storing condensate liquid, a lid releasably connectable to the body to form the tank, a mounting bracket for fixing the lid to a mounting surface, an inlet port for condensate liquid from the air conditioning system, an outlet port for condensate liquid from the tank, a sensor for determining whether an amount of condensate liquid in the tank exceeds a threshold value, and a controller for controlling removal of the condensate liquid from the tank via the outlet port when the sensor determines that the threshold value has been exceeded.

With this arrangement, the tank can be mounted to a mounting surface, such as a wall or ceiling, via the lid. The body can then be detached from the lid and removed to allow internal components of the tank to be serviced or replaced. Consequently, it is not necessary to provide a clearance between the lid and the air conditioning system. Thus, the tank may be positioned much closer to the air conditioning system than would be otherwise possible, resulting in a compact arrangement. This arrangement also has the advantage that the lid and body can be separated for maintenance without disturbing any sensors provided in the lid, since the lid is unmoved.

Preferably, the tank comprises at least one resilient clip for releasably connecting the lid to the body. This enables the quick and straight-forward assembly of the tank and the quick and straight-forward release of the body from the lid for cleaning and/or maintenance operations.

The sensor may be robust enough to withstand damage and/or dislodgement during the assembly of the tank, or during removal of the body from the lid. Alternatively, the tank may further comprise a barrier which at least partially surrounds the sensor. In addition to protecting the sensor during the assembly or disassembly of the body and the lid, the barrier may also serve to reduce the instances of false readings by the sensor. Such false readings may be caused by a build-up of organic sludge in the condensate tank, or by splashing of the sensor by condensate when it enters the tank.

Preferably, the barrier is mounted on the underside of the lid and extends away from the lid at least as far as the end of the sensor. With this configuration, if the sensor is also mounted on the lid, relative movement between the sensor and the barrier is reduced. This can help to prevent damage to the sensor caused by side loading from the barrier. Further, by extending at least as far as the end of the sensor, the level of protection provided by the barrier may be increased.

Preferably, the barrier is formed integrally with the lid. This reduces the number of components requiring assembly and the time taken to assemble the tank.

Alternatively, the barrier is formed as a separate component which is retained with respect to the sensor and rotatably and axially moveable relative to the sensor.

Preferably, a gap of at least 1 mm is provided between the barrier and the sensor. This prevents beads of condensate from forming between the sensor and the barrier which may cause false sensor readings. Preferably, the gap is in the range of 1.2-1.8 mm.

The barrier may comprise a plurality of elongate prongs extending substantially parallel to a longitudinal axis of the sensor.

Preferably, the tank comprises a second sensor for determining whether an amount of condensate liquid in the tank exceeds a second threshold value. With this arrangement, the controller may be configured to turn-off the air conditioning unit to prevent the condensate level from rising further, or activate a warning mechanism such as an audible and/or visual alarm, once the second threshold level has been reached. Thus, the second sensor forms part of a failsafe system.

Preferably, the sensor comprises a resilient clip for retaining the sensor in the lid. This enables the quick installation of the sensor into the lid and reduces the environmental hazards associated with using adhesives or potting compounds.

The tank could be provided with a single inlet port and a single outlet port. Alternatively, the inlet port and the outlet port may be located either in the lid or the body and a second inlet port and outlet port located in the other of the lid or body. Further, one of the inlet ports and one of the outlet ports may be selectively closable by a user. This enables multiple permutations for the connection of hoses to the tank to suit various installations.

When installed, a cable of the sensor, connecting the sensor to the pump, which in turn is connected to the air conditioning unit, could hang over the side of the tank, or rest on top of the lid of the tank. With such an arrangement, the lid could not be mounted flush with the air conditioning unit unless a recess were to be provided in the air conditioning unit. Alternatively, the lid comprises a cable recess for accommodating the cable of the sensor. This enables the sensor cable to be located in the recess such that it can be flush mounted to the lid. This further improves the appearance of the system and enables the tank to be positioned against the air conditioning unit.

Preferably, the cable recess extends from a mounting location of the sensor to more than one location on an edge of the lid. This enables the cable to be routed in alternative directions depending on the configuration of the air conditioning system.

The ports may protrude beyond the external surfaces of the tank, such that the connector portions of any hoses connected to the ports are plainly visible. Alternatively, at least one of the inlet or outlet ports is surrounded by a connector recess. With this configuration, the port and the connector portion of any hose connected to the port can be positioned within the recess, thus improving the appearance of the air conditioning system and enabling the tank to be positioned against the air conditioning unit.

The present invention also provides an air conditioning system comprising a condensate collection tank as set out above.

The present invention further provides a boiler system comprising a condensate collection tank as set out above.

The present invention will now be described in detail, by way of example only, with reference to the accompanying drawings, in which.

Figure 1:
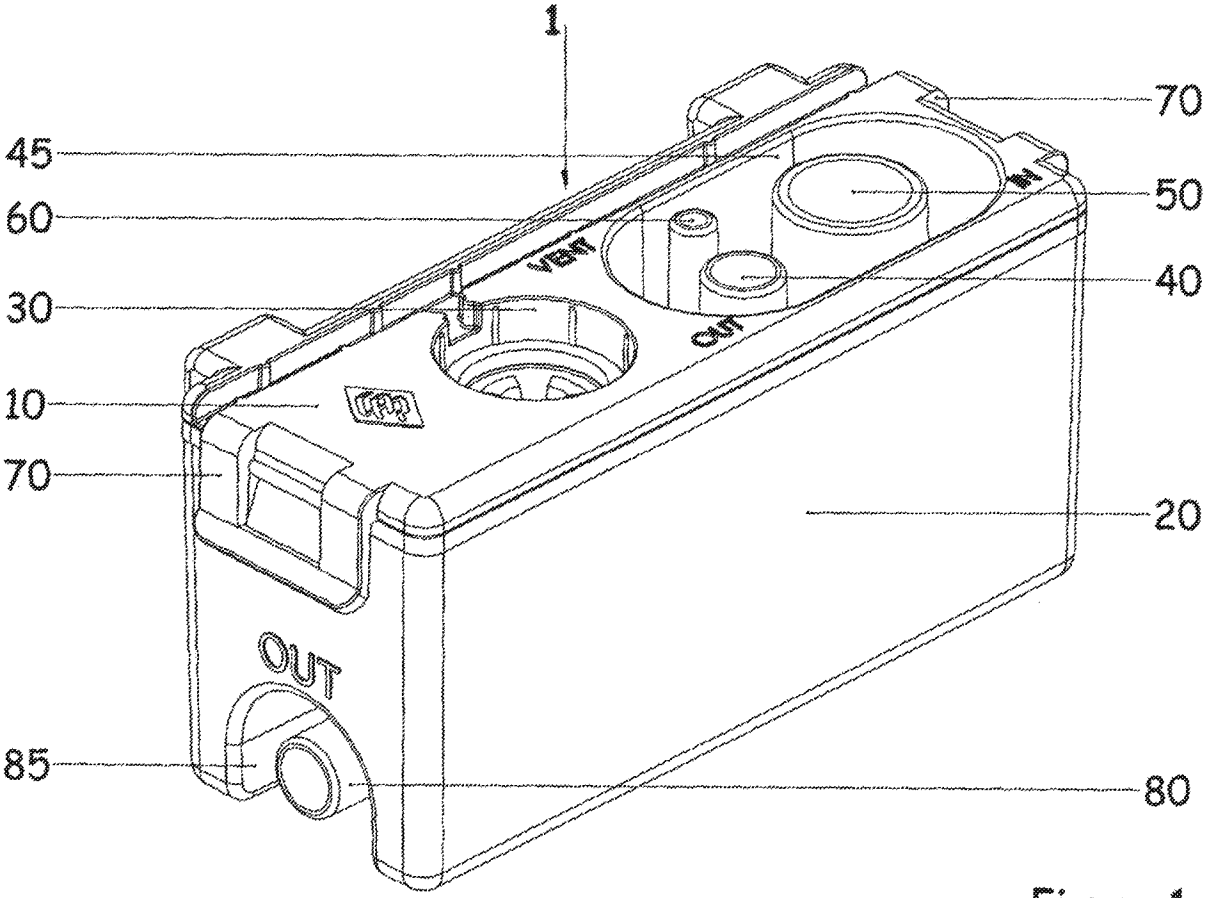
FIG. 1 is a perspective view of a condensate collection tank in accordance with the present invention, with the sensor removed for clarity.

The condensate collection tank 1 is shown in FIG. 1, and comprises a lid 10, a body 20 for storing condensate liquid, a sensor recess 30, a lid outlet port 40, a lid inlet port 50 and a vent port 60.

Figure 5:
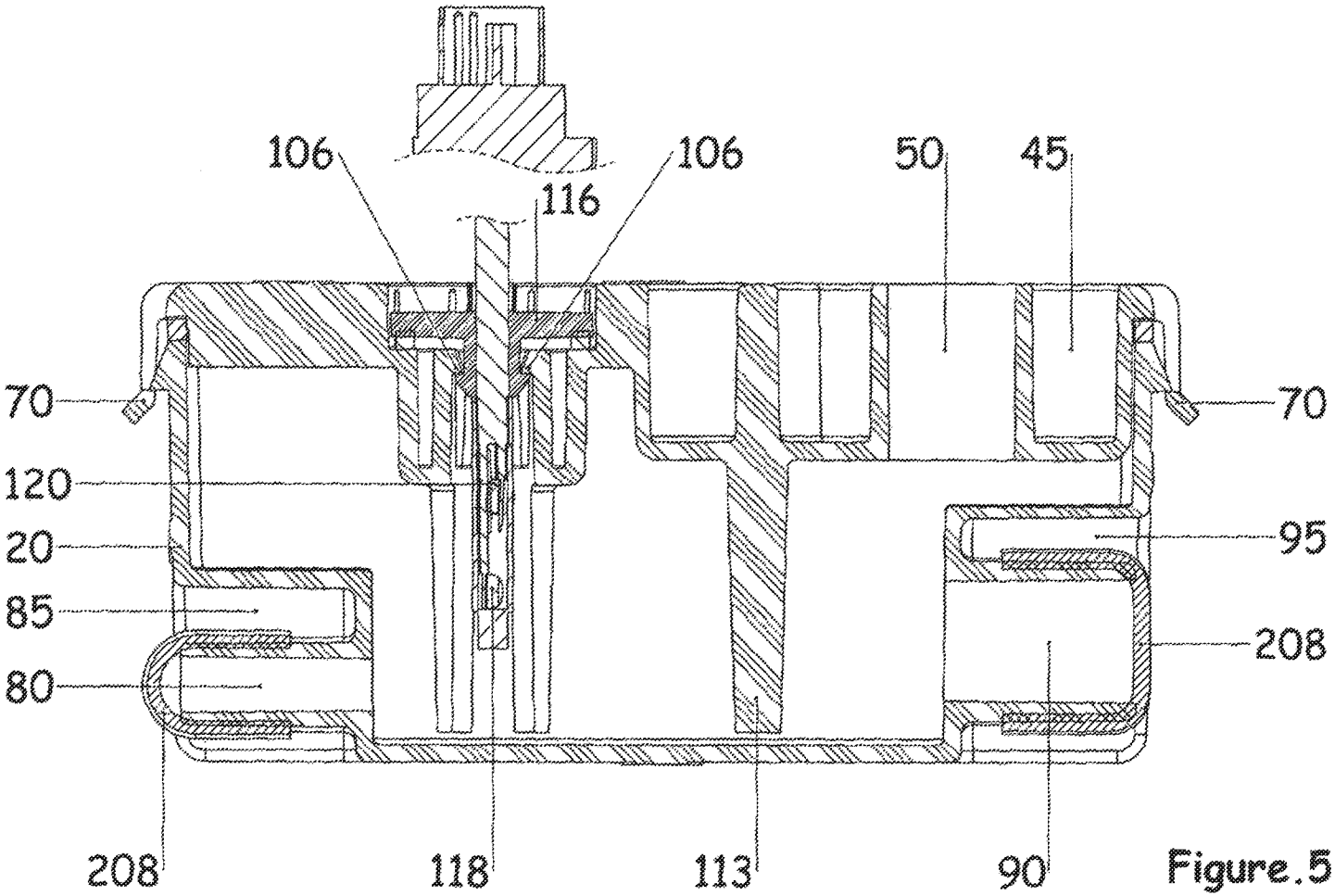
FIG. 5 is a section view through line A-A of the condensate collection tank of FIG. 2, showing the sensor and port caps.

The lid outlet port 40, the lid inlet port 50 and the vent port 60 are formed in a lid port recess 45 which extends around the ports 40, 50, 60, such that the top of each of the ports 40, 50, 60 does not protrude beyond the outer surface of the lid 10. Similarly, the body 20 is provided with a body outlet port 80 formed in a body outlet port recess 85 extending around the port 80, and a body inlet port 90 formed in a body inlet port recess 95 extending around the port 90, such that the body outlet and inlet ports 80, 90 do not protrude beyond the outer surface of the body 20 (as shown in FIG. 5 and discussed below).

The tank 1 also comprises a flexible clip 70 on either side of the lid 10, each clip 70 mating with a corresponding lug or recess (not shown) on the body 20. The tank 1 can be formed of any suitable material. Beneficially, such material will be resistant to ultra-violet light and temperature For example, the tank may be formed from injection-molded polycarbonate.

Figure 2:
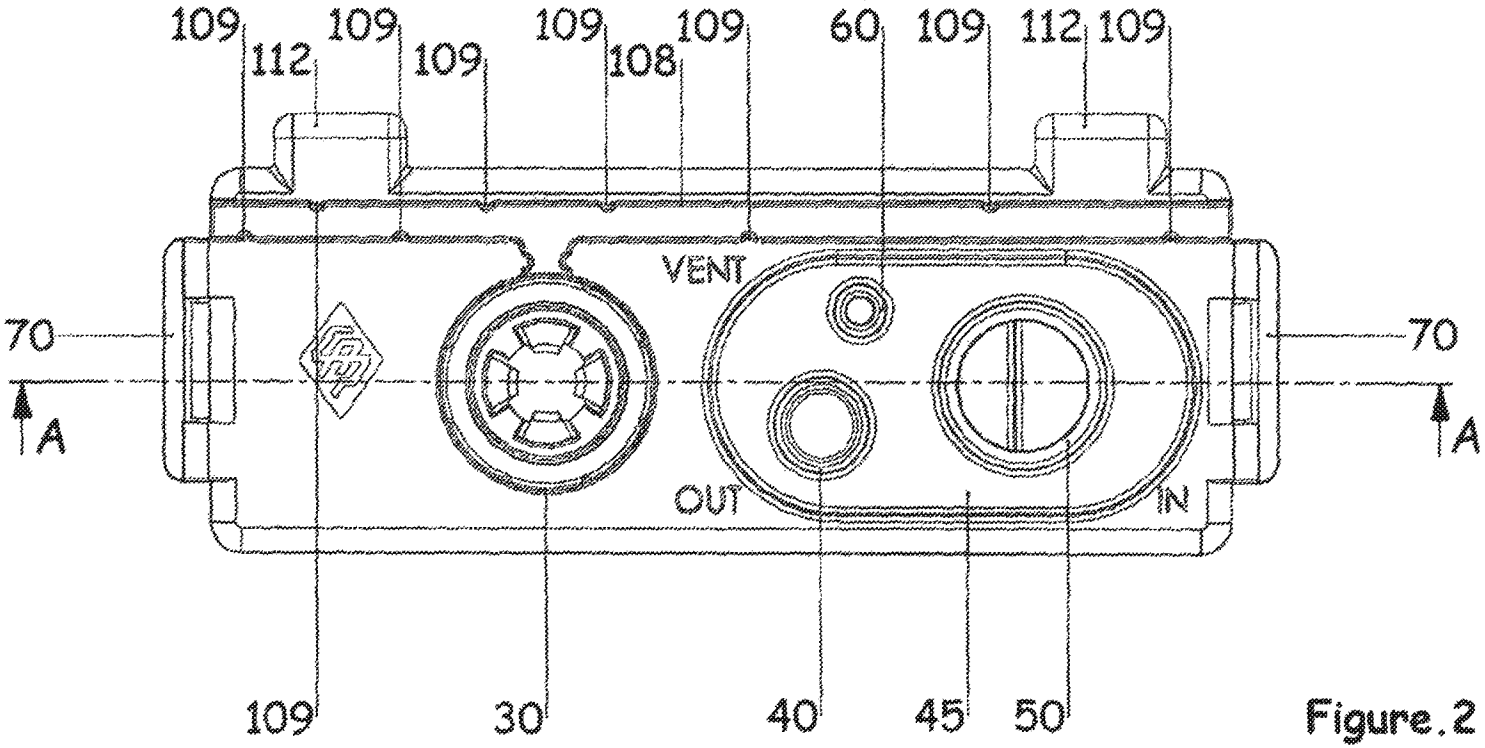
FIG. 2 is a plan view of the lid of the condensate collection tank of FIG. 1.
Figure 3:
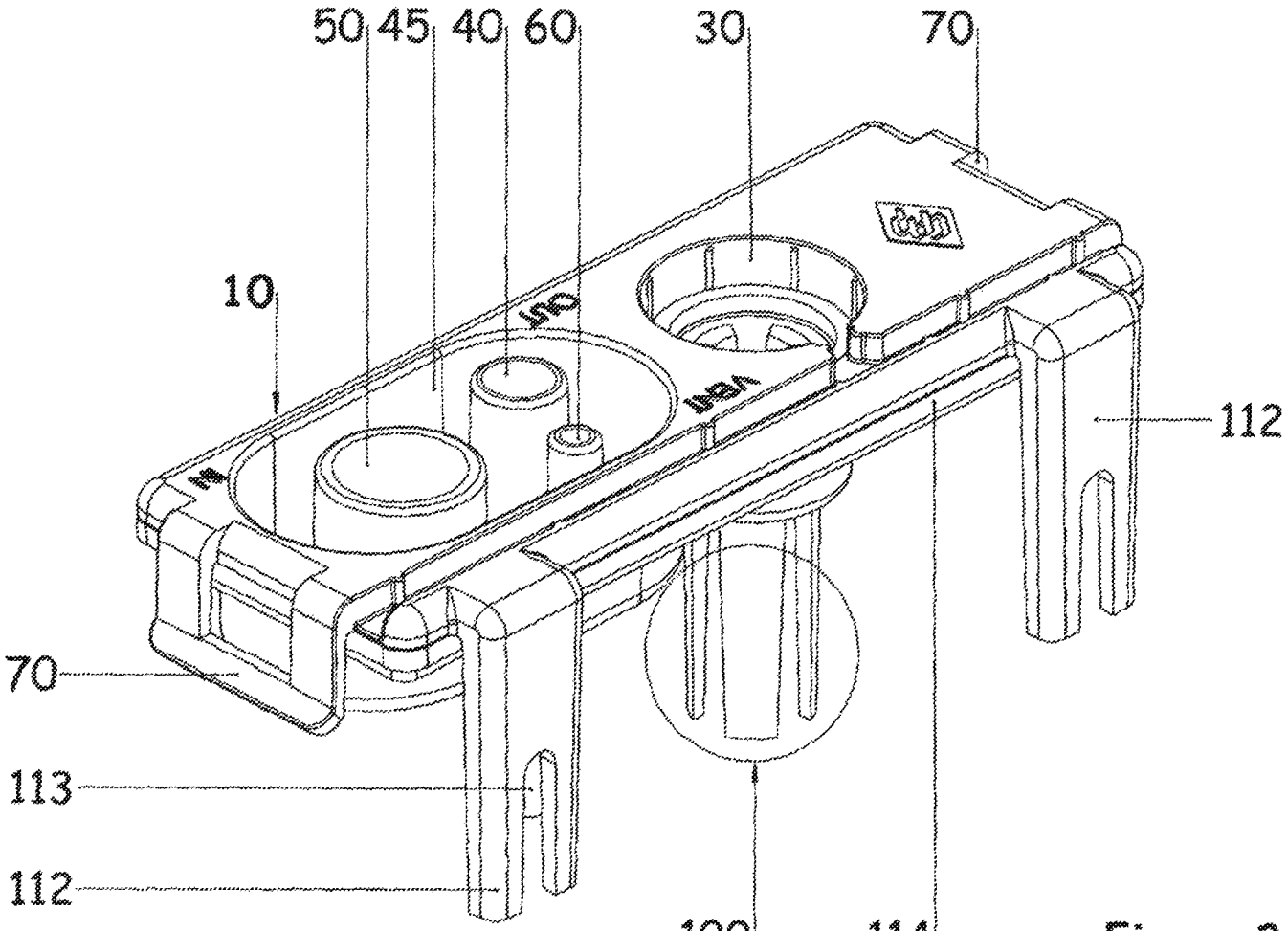
FIG. 3 is a plan perspective view of the lid of the condensate collection tank of FIG. 1.
Figure 4:
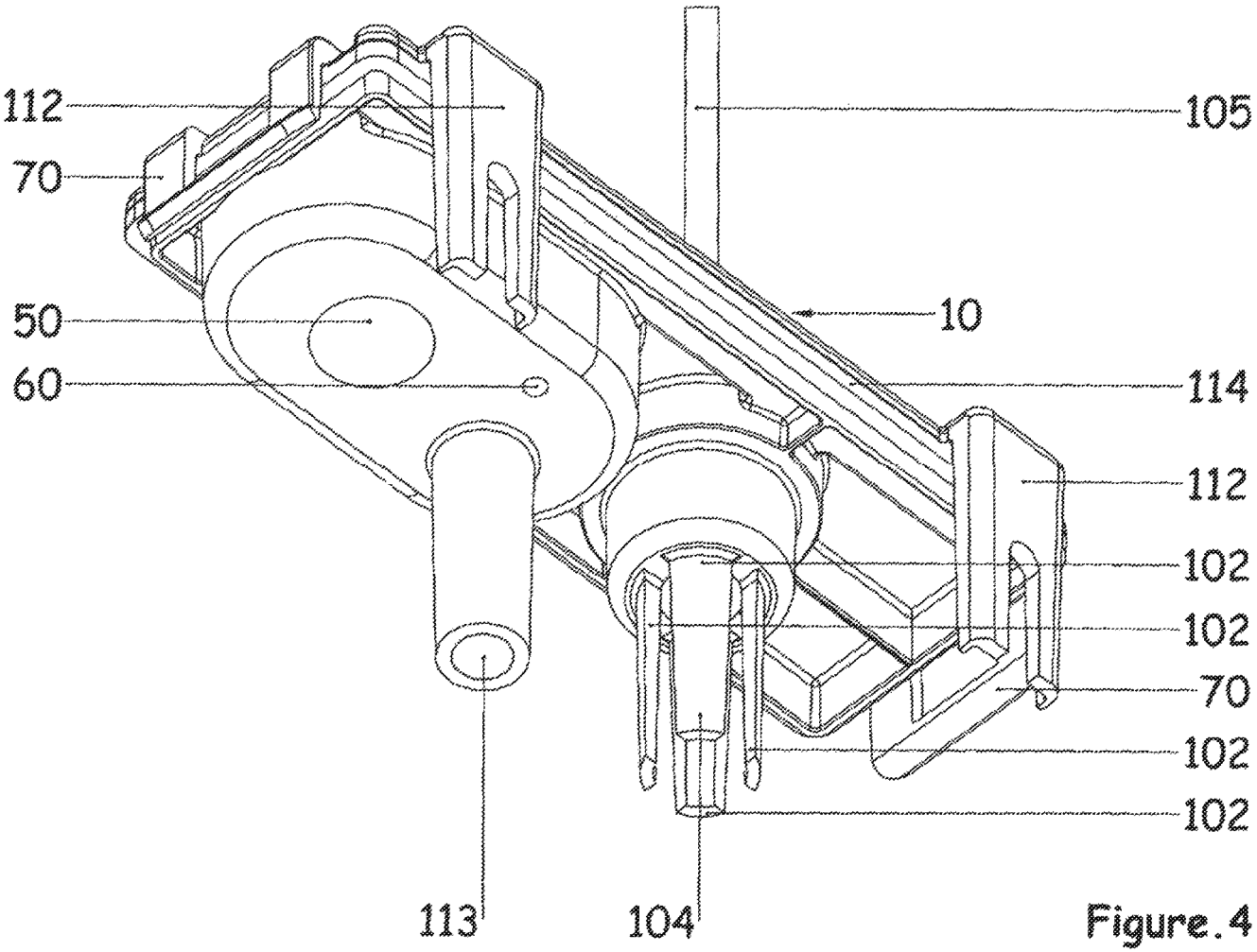
FIG. 4 is a bottom perspective view of the lid of the condensate collection tank of FIG. 1, showing the sensor.

As shown in FIGS. 2 to 4, the lid 10 of the tank 1 comprises a barrier 100 integrally molded to the underside of the lid 10. In this example, the barrier 100 comprises four elongate prongs 102 extending substantially parallel to a sensor 104 of the tank 10, from the bottom of the sensor recess 30 to the bottom of the sensor 104. A gap of at least 1 mm is provided between the sensor 104 and each of the prongs 102. The sensor recess 30 has sensor latches 106 for retaining the sensor 104 in the lid 10.

The lid 10 further comprises a cable recess 108 and a port recess 110. The cable recess 108 extends from the sensor recess 30 to either lateral edge of the lid 10 and includes cable lugs 109 which serve to provide an interference fit with the cable 105 of the sensor 104. The lid 10 has two mounting brackets 112 attached to one side, for fixing the lid 10 to a mounting surface. The lid outlet port 40 comprises an outlet port tube 113 extending from the bottom of the port recess 110 towards the bottom of the tank 1, for allowing condensate to be drawn out of the tank 1 by a pump (not shown). The lid 10 also has a gasket 114 around its circumference for providing a hermetic seal between the lid 10 and the body 20 when the tank 1 is assembled. In this example, the gasket 114 is formed from a closed-cell foam.

As shown in FIG. 5, the body 20 comprises a body outlet port 80 located in a body outlet port recess 85 and a body inlet port 90 located in a body inlet port recess 95. The body outlet and inlet ports 85, 95 are shown as being closed by port caps 208 to prevent the escape of condensate through these ports. However, the port caps 208 may be placed over the lid inlet and outlet ports 40, 50 in an alternative installation.

As further shown in FIG. 5, the sensor cable 105 has a lug 116 for retention of the cable 105 in the sensor latches 106 of the lid 10. In this example, the sensor has a first thermistor bead 118 towards its distal end for sensing when the condensate level reaches a first threshold value and a second thermistor bead 120 towards its proximal end for sensing when the condensate level reaches a second threshold value.

Figure 6:
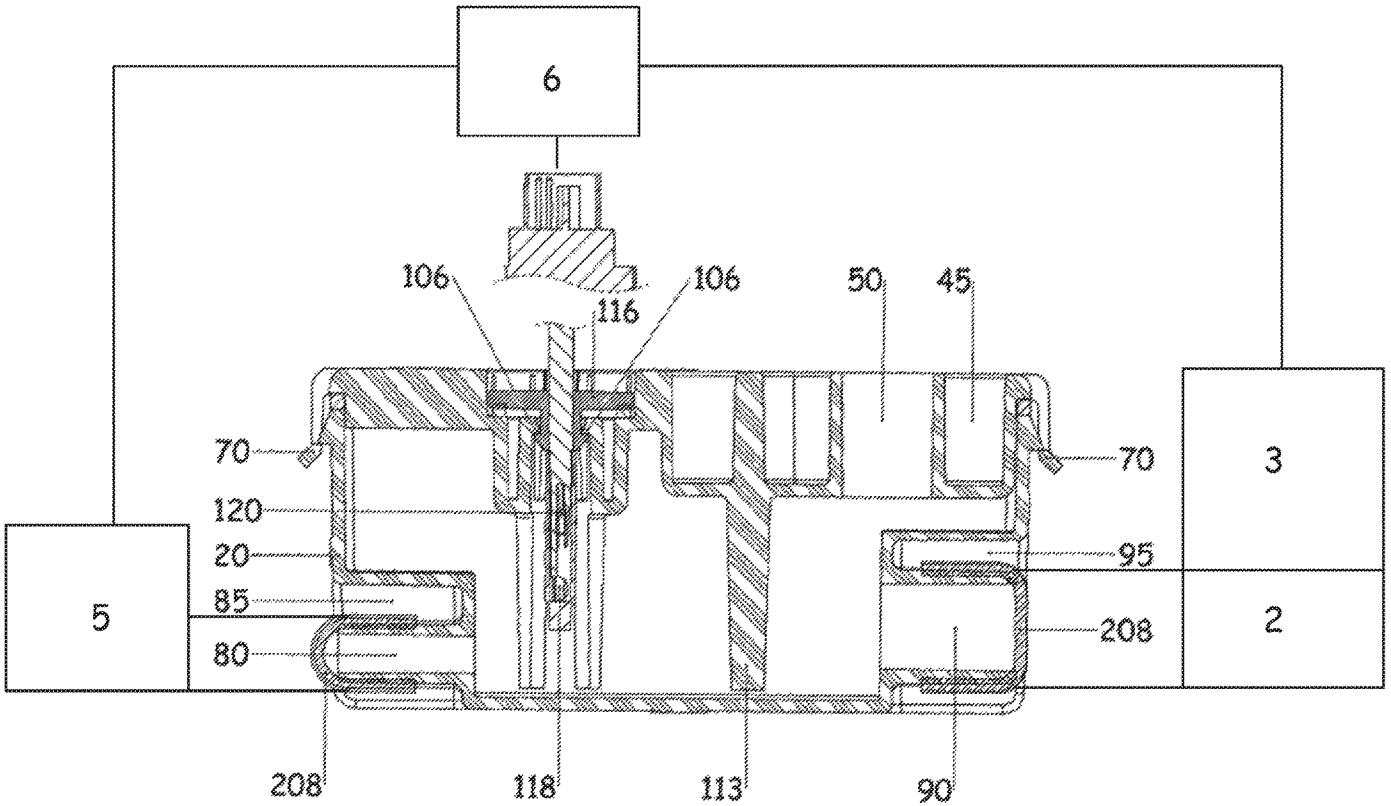
FIG. 6 is a view of the condensation collection tank as shown in FIG. 5 connected to an air conditioning unit and a pump.

As shown in FIG. 6, to install the tank 1, the drain tray 2 of the air conditioning unit 3 (not shown to scale) is connected to either the lid inlet port 50, or the body inlet port 90, depending on the intended configuration of the air conditioning system. This connection may be made by use of an inlet hose 4 or by way of a fixed port on the air conditioning unit. The pump 5 (not shown to scale) is connected to either the lid outlet port 40 or the body outlet port 80. Port caps 208 are placed over the inlet or outlet ports which remain unconnected to, in order to selectively close these ports. A vent hose (not shown) is connected to the vent port 60. Since the tank 1 is provided with port recesses 45, 85, 95, the hose connectors and port caps 208 are contained within the confines of the tank 1.

The sensor cable 105 is then located in the cable recess 108 in the desired direction and held in position by the cable lugs 109. The lid 10 is then attached to a mounting surface, for example a wall, using the mounting brackets 112. This can be achieved in any conventional manner, for example by using self-tapping screws. The body 20 is then connected to the lid 10 using the clips 70 to form the tank. The foam gasket 114 around the circumference of the lid 10 creates a hermetic seal between the lid 10 and the body 20 which can be maintained despite creep and/or shrinkage of the lid 10 and/or body 20 over time.

The flush mounting of the sensor cable 105 in the cable recess 108 and port recesses 45, 85, 95 allows the tank 1 to be flush mounted against the air conditioning unit.

In use, the condensate enters the collection tank 1 via the inlet hose and the inlet port to which the hose is connected. During the ingress of condensate, the sensor 104 is shielded from the inrush of cold water by the barrier 100. The condensate liquid which has entered the tank 1 is thus stored in the body 20 of the tank 1.

Once the condensate liquid reaches the first threshold level, it is sensed by the first sensor and the controller 6 (shown in FIG. 6) activates a pump to discharge the condensate via the outlet hose and the outlet port to which the hose is connected. If the condensate level continues to rise to the second threshold level, it is sensed by the second sensor and the controller 6 sets off an alarm that can deactivate the air conditioning unit. In this manner, if the first sensor should fail, the second sensor provides a failsafe. If the condensate level falls below the second threshold level, the air conditioning unit may be restarted. Nevertheless, if the condensate level rises further, it will exit the tank 1 through the vent port 60 where it can be conveyed to any suitable location. For example, the condensate could be returned to the drain tray, to an additional tank, or to an exterior gutter, as required by the installer or layout of the building.

The invention claimed is:

1. A method of operating an air conditioning system comprising:

an air conditioning unit comprising a drain tray;

a pump; and a condensate collection tank comprising:

a body for storing condensate liquid;

a lid releasably connectable to the body to form the tank;

at least two mounting brackets, each of which is for fixing the lid to a same mounting surface, the mounting surface separate from the condensate collection tank, wherein the body is detachable from the lid with the lid still attached to the mounting brackets;

an inlet port for condensate liquid from the air conditioning system;

a first outlet port which is selectively closable by a user, for condensate liquid from the tank, and which extends through the lid;

a second outlet port which is selectively closable by a user, for condensate liquid from the tank, and which extends through the body;

a thermistor bead sensor for determining whether an amount of condensate liquid in the tank exceeds a threshold value;

a controller for controlling removal of the condensate liquid from the tank via the first outlet port and the second outlet port when the sensor determines that the threshold value has been exceeded; and wherein the pump is located outside the condensate collection tank;

wherein the inlet port is connected to the drain tray from the air conditioning unit;

wherein one of the first outlet port and the second outlet port is connected to the pump;

wherein the other of the first outlet port and the second outlet port is closed;

wherein the lid comprises a cable recess for accommodating a cable of the sensor;

wherein the cable recess extends from a mounting location of the sensor to more than one location on an edge of the lid;

wherein the method comprises the steps of:

i) receiving condensate liquid, from the drain tray of the air conditioning unit, via the inlet port, into the condensate collection tank;

ii) using the controller to start the operation the pump when the sensor determines that the threshold value has been exceeded; and iii) operating the pump to remove the condensate liquid from the condensate collection tank via the one of the first outlet port and the second outlet port connected to the pump.

2. The method according to claim 1, the tank further comprising at least one resilient clip for releasably connecting the lid to the body.

3. The method according to claim 1, the tank further comprising a barrier which at least partially surrounds the sensor.

4. The method according to claim 3, wherein the barrier is mounted on an underside of the lid and extends away from the lid at least as far as an end of the sensor.

5. The method according to claim 4, wherein the barrier is formed integrally with the lid.

6. The method according to claim 3, wherein the barrier is formed as a separate component which is retained with respect to the sensor and rotatably and axially moveable relative to the sensor.

7. The method according to claim 3, wherein a gap of at least 1 mm is provided between the barrier and the sensor.

8. The method according to claim 3, wherein the barrier comprises a plurality of elongate prongs extending substantially parallel to a longitudinal axis of the sensor.

9. The method according to claim 1, the tank further comprising a second sensor for determining whether an amount of condensate liquid in the tank exceeds a second threshold value.

10. The method according to claim 1, wherein the sensor comprises a resilient clip for retaining the sensor in the lid.

11. The method according to claim 1, wherein at least one of the inlet or outlet ports is surrounded by a connector recess extending inwardly of the lid.

12. The method according to claim 2, wherein the tank comprises two resilient clips for releasably connecting the lid to the body.

13. The method according to claim 12, wherein one of the two resilient clips is located on a first side of the lid, and the other of the two resilient clips is located on a second side of the lid which is opposite the first side of the lid.

14. The method according to claim 1, wherein the mounting brackets are integrally formed with the lid.

15. The method according to claim 1, wherein the mounting brackets extend from the lid towards the bottom of the tank.

16. The method according to claim 1, wherein the tank is formed from injection-molded polycarbonate.

17. The method according to claim 1, wherein the lid comprises a gasket around its circumference for providing a hermetic seal between the lid and the body.

18. The method according to claim 1, wherein the thermistor bead sensor is connected to the lid.

19. The method according to claim 9, wherein the controller is operable to create an alarm signal in response to the second sensor determining that an amount of condensate liquid in the tank exceeds the second threshold value.

20. The method according to claim 1, the tank further comprising a vent port for removing condensate liquid from the tank when the amount of condensate liquid in the tank exceeds a predetermined amount.

21. The method according to claim 1, wherein the second outlet port is surrounded by a connector recess extending inwardly of the body.

22. The method according to claim 1, wherein the inlet port does not protrude from the outer surface of the body.

23. The method according to claim 1, wherein the second outlet port does not protrude from the outer surface of the body.

* * * * *